US006780573B1

(12) United States Patent
Singer et al.

(10) Patent No.: US 6,780,573 B1
(45) Date of Patent: Aug. 24, 2004

(54) COLOR PHOTOGRAPHIC ELEMENT CONTAINING COUPLER MOIETY WITH IMPROVED AMINO ACID TIMING GROUP

(75) Inventors: Stephen P. Singer, Spencerport, NY (US); Christopher W. Grote, Rochester, NY (US); Robert C. Stewart, Spencerport, NY (US); Janet N. Younathan, Fairport, NY (US); Jerrold N. Poslusny, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/449,363

(22) Filed: May 30, 2003

(51) Int. Cl.[7] ..... G03C 7/46

(52) U.S. Cl. ..... 430/382; 430/385; 430/387; 430/389; 430/543; 430/544; 430/505; 430/955; 430/553; 430/555; 430/558

(58) Field of Search ..... 430/543–544, 430/505, 955, 553, 555, 558, 382, 385, 387, 389

(56) References Cited

U.S. PATENT DOCUMENTS

| | | | | |
|---|---|---|---|---|
| 3,658,537 A | * | 4/1972 | Credner et al. | 430/552 |
| 4,482,629 A | | 11/1984 | Nakagawa et al. | |
| 4,847,185 A | | 7/1989 | Begley et al. | |
| 4,857,440 A | * | 8/1989 | Begley et al. | 430/382 |
| 5,021,322 A | | 6/1991 | Begley et al. | |
| 5,151,343 A | * | 9/1992 | Begley et al. | 430/382 |
| 5,272,043 A | | 12/1993 | Begley et al. | |
| 5,283,340 A | * | 2/1994 | Begley et al. | 548/144 |
| 5,306,607 A | * | 4/1994 | Begley et al. | 430/544 |
| 5,932,407 A | | 8/1999 | Begley et al. | |
| 6,083,675 A | | 7/2000 | Bell et al. | |

FOREIGN PATENT DOCUMENTS

JP 6-175310 6/1994

OTHER PUBLICATIONS

Abstract—Fuji Photo Film, 1994–175310 "Silver Halide Color Photographic Sensitive Material".

* cited by examiner

*Primary Examiner*—Geraldine Letscher
(74) *Attorney, Agent, or Firm*—Sarah Meeks Roberts

(57) ABSTRACT

The invention relates to a color silver halide photographic element comprising a light-sensitive silver halide emulsion layer, said silver halide emulsion being in reactive association with an amino acid compound according to Formula (I):

Formula (I)

wherein:

COUP is a moiety that reacts with oxidized developer to release the amino acid timing group but does not substantially contribute any density in the visible region to the element after processing is complete;

n is 0 or 1;

$R_1$ is an alkyl or alkenyl group of 4 carbon atoms or more or an aryl group with 10 carbon atoms or more;

$R_2$ is an alkyl or aryl group so the sum total of carbon atoms in $R_1$ and $R_2$ together are at least 5; and PUG is a photographically useful group.

21 Claims, No Drawings

COLOR PHOTOGRAPHIC ELEMENT CONTAINING COUPLER MOIETY WITH IMPROVED AMINO ACID TIMING GROUP

FIELD OF THE INVENTION

This invention relates to a silver halide color photographic element containing a coupler moiety that does not form a permanent dye and that releases a photographically useful group (PUG) upon reaction with oxidized developer through an improved amino acid timing group. The coupler moiety may be contained in a light-sensitive silver halide emulsion layer or in an adjacent light-insensitive layer.

BACKGROUND OF THE INVENTION

It is well known in the photographic art to use coupling species to release photographically useful groups or PUG in an imagewise fashion upon reaction with oxidized developer. It is also well known in the art to use a so-called "timing group" (also sometimes referred to as a "linking group" or "switch") as an intermediate fragment chemically bound between the coupling site and the PUG. Upon reaction with oxidized developer, the entire "timing group-PUG" fragment is released and subsequently decomposes to release the free PUG. A timing group can serve one or more of three purposes: it can delay the presence of the free PUG if the decomposition is slow; it can serve as a convenient way to attach the PUG to the coupling moiety; or it can serve to modify the overall performance or physical properties of the entire molecule.

Timing groups are particularly useful when the PUG is an inhibitor of silver development (INH). Couplers which release development inhibitors, either directly or through the use of an intermediate timing group, are typically referred to as development inhibitor releasers or DIRs. For DIRs that release an inhibitor directly without a timing group, the inhibitor fragment will reduce the silver development in the layer in which it is released, thereby reducing the speed and light sensitivity of that record. Any interimage effect (decreased development in other layers as a function of development in one layer) will be due to the inherent diffusibility of the inhibitor molecule.

When the DIR employs a timing group, diffusion of the 'timing group-INH' fragment away from the initial site of release and slow decomposition to free INH is useful for increasing the sharpness and degree of interimage of the film. The diffusion of the INH fragment improves sharpness by increasing the amount of chemical adjacency effects. Interimage, which is a change in the development of different color record as a function of exposure of one record, arises from diffusion of the INH generated by development in one color record into another. For both acutance and interimage, the greater the degree of diffusion away from the site of release, the greater are the improvements. In order to accomplish these purposes, it is generally assumed that neither the timing group nor the INH can contain a ballast group that would restrict diffusion. If the timing group is ballasted, then it will not diffuse far from the initial site of coupling and free INH will only be generated in the same vicinity. This leads to speed losses in the layer that contains the DIR. Ballasting of the INH fragment is also undesirable since the ballast group prevents diffusion of the INH into other layers, increases the inhibitor strength, and leads to silver retention after processing due to the formation of insoluble silver salts. It is necessary, however, that a DIR contain a ballast somewhere in the molecule prior to processing so that the entire molecule does not wander between layers in a film element. Thus, unballasted 'timing group-INH' fragments are typically used in combination with coupler moieties that are ballasted and form permanent dyes after coupling.

DIRs that form permanent dyes that contribute density to the color record after processing are commonly used in the appropriate color record for the color generated. For example, cyan DIRs are typically used in red sensitive layers with cyan image couplers, magenta DIRs are used in green sensitive layers with magenta image couplers, and yellow DIRs are used in blue sensitive layers with yellow image couplers. Although they can be used in any color record to create acutance and interimage effects, location in the wrong color record is inefficient due to color contamination from the parent coupler.

In some cases, it is desirable to release a PUG or an inhibitor in a particular color record from a coupler moiety that does not form a permanent dye in order to prevent color contamination. Coupler moieties that do not form a permanent dye and leave no or little residual color in the film after processing are generally known as 'universal' couplers because they may be used in any color record. There are two types of universal couplers—those that form a dye that is unstable under the processing conditions and that forms a colorless residue that remains in the film, or those that form a stable dye that is subsequently washed out or removed during processing. Universal couplers based on 2-carbamoyl-1-naphthol compounds with small or water-solubilizing groups substituents on the carbamoyl group are well known in the art, for example, see U.S. Pat. No. 5,932,407 and U.S. Pat. No. 6,083,675. Such 2-carbamoyl-1-naphthol-based universal couplers have been used as DIRs, for example, see U.S. Pat. No. 4,482,629 and U.S. Pat. No. 5,272,043. In such DIRs, however, it is necessary to locate the ballast group on the timing group since it is undesirable to ballast either the parent or the INH fragment. Thus, the timing group has limited mobility, and the benefits of diffusing the 'timing group-INH' fragment are not fully realized. For practical use, such ballasted timing groups are generally designed to release the INH fragment very quickly and without delay on the photographic timescale; thus, the ballasted timing group serves only as a temporary linking group, and the material performs as if there was direct release of INH. Any acutance and interimage improvements are the result of the inherent diffusivity of the INH fragment alone.

It should be noted that although such 2-carbamoyl-1-naphthols are often referred to as 'wash-out' type couplers, the mechanism is likely to be one of reaction of the initial formed cyan dye by sulfite ion present in the process to form colorless addition products which may or may not wash of the film depending on the nature of the film element. A discussion of the decolorization mechanism can be found in L. K. J Tong and R. L. Reeves, JACS, 84, 2050–7 (1962).

Timing groups based on amino acids are known. U.S. Pat. No. 4,857,440 describes the use of acyclic amino acid derivatives, including those derived from N-alkyl-alanines and 2-(methyl or ethyl)-N-phenyl-alanines, as timing groups. This reference teaches that having a "bulky" substituent in the amino acid next to the carbonyl provides increased resistance towards hydrolysis during long-term storage. U.S. Pat. No. 5,021,322 describes similar acyclic amino acid groups as part of a double timing group fragment. This reference solves the problem of ballast location on universal DIRs by using two linked timing groups, one which is ballasted together with an amino acid based timing group that is not. Such double-switched DIRs, however, are complicated and difficult to manufacture in an economical manner. U.S. Pat. No. 4,847,185 describes the use of cyclic amino acid derivatives as timing groups.

Japanese Kokai 6-175310 shows an example of a universal DIR that utilizes a ballasted 2,2-dimethyl-3-anilinopropionic acid based timing group (see p. 14, compound (8)). However, amino acid derivatives with alpha-dimethyl substitution such as 2,2-dimethyl-3-aminoproprionic acid or 2-alkyl-alanines are exceedingly difficult to esterify, presumably due to their steric hindrance. Therefore, the preparation of DIRs with this type of timing group is low yielding, leading to high cost and an undesirable manufacturing position.

A problem to be solved is to provide color photographic elements that exhibit improved photographic speed, acutance and interimage at low cost, and methods for processing such elements. In particular, it is desirable to provide color photographic elements with improved speed and interimage using universal DIRs with an improved type of amino acid timing group.

SUMMARY OF THE INVENTION

The invention provides a color silver halide photographic element comprising a light-sensitive silver halide emulsion layer, said silver halide emulsion being in reactive association with an amino acid compound according to Formula (I):

Formula (I)

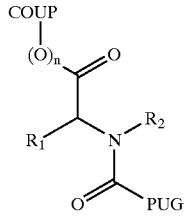

wherein:

COUP is a moiety that reacts with oxidized developer to release the amino acid timing group but does not substantially contribute any density in the visible region to the element after processing is complete;

n is 0 or 1;

$R_1$ is an alkyl or alkenyl group of 4 carbon atoms or more or an aryl group with 10 carbon atoms or more;

$R_2$ is an alkyl or aryl group so the sum total of carbon atoms in $R_1$ and $R_2$ together are at least 5; and PUG is a photographically active group. The invention further provides methods for processing such elements.

The invention provides color photographic elements that exhibit improved photographic speed and interimage. Further, the amino acid compounds are easy and economical to manufacture. The amino acid compounds utilized in the invention contain an amino acid timing group with a large group adjacent to the carboxylic ester link to the coupling site. Not only does this group allow for excellent keeping of the film before processing by increasing resistance towards hydrolysis of the ester group and preventing diffusion of the entire molecule into other layers of the film, but it also unexpectedly provides more interimage in other color records while minimizing speed loss in the layer in which it is incorporated relative to known types of ballasted timing groups. Because the large group of the amino acid timing group confers enough diffusion resistance to the entire molecule, the parent coupling moiety does not need to be ballasted so that the dye formed after coupling with Dox can be efficiently removed from the film or destroyed during processing.

DETAILED DESCRIPTION OF THE INVENTION

The color silver halide photographic element useful in the present invention comprises a support bearing at least one light sensitive silver halide emulsion layer. In one preferred embodiment the present invention comprises a support bearing a cyan dye image-forming unit (aka a color record) comprised of at least one red-sensitive silver halide emulsion layer having associated therewith at least one non-diffusing cyan dye-forming coupler, a magenta dye image-forming unit comprising at least one green-sensitive silver halide emulsion layer having associated therewith at least one non-diffusing magenta dye-forming coupler, and a yellow dye image-forming unit comprising at least one blue-sensitive silver halide emulsion layer having associated therewith at least one non-diffusing yellow dye-forming coupler. It is preferred that the color silver halide elements are negative working silver halide elements. It is also preferred that the silver halide photographic elements are capture or origination elements such as a color negative film or a motion picture origination film.

The amino acid compounds used in the invention are represented by Formula (I):

Formula (I)

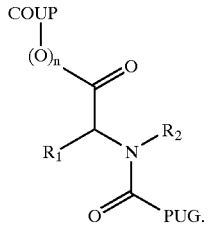

COUP in Formula (I) can be any moiety that reacts with oxidized developer to release the amino acid timing group, i.e., Formula (Ia) so long as there is no significant increase in visible density after processing is complete. These types of couplers are typically referred to as universal couplers. The reaction may be a coupling reaction or a redox reaction. After coupling with oxidized developer, COUP may form a permanent or stable colorless adduct that can remain in the film or wash out of the film. It may also form an unstable or fugitive dye which leaves little or no residual color in the film, or an unstable adduct which further decomposes. COUP can also be attached to a polymeric backbone.

Formula (Ia)

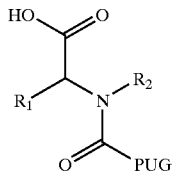

One typical class of universal couplers are cyclic carbonyl containing compounds that form colorless products on reaction with an oxidized color-developing agent and are described in such representative patents as: UK 861,138 and U.S. Pat. Nos. 3,632,345; 3,928,041; 3,958,993 and 3,961, 959. Another particularly suitable class are 2-carbamoyl-1-naphthols such as those described in U.S. Pat. Nos. 4,482,629 and 5,272,043. In these cases, n is 1, and the oxygen of the amino acid timing group is attached to the coupling site of COUP.

It is also possible the COUP releases the amino acid timing group according to Formula (Ia) via a redox reaction, after which COUP may form a stable or unstable species or may wash out of the film. An example of a class that releases by a redox mechanism are hydrazides such as those described in U.S. Pat. No. 4,684,604. In this case, n is 0, and the nitrogen of the hydrazine moiety is attached to the carbonyl of the amino acid timing group. The amino acid timing group of Formula (Ia) is subsequently formed by water hydrolysis of the oxidized hydrazine moiety.

In a preferred embodiment COUP is a 2-carbamoyl-1-naphthol derivative represented by Formula A:

(Formula A)

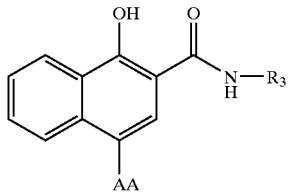

wherein $R_3$ represents hydrogen, an alkyl group with 4 carbon atoms or less, an alkyl group with a water-solubilizing group and 8 carbon atoms or less, an aryl group of 7 carbon atoms or less or an aryl group with a water-solubilizing group and 10 carbon atoms or less; and AA represent an amino acid switch of the type described in Formula (Ia). The naphthol nucleus may optionally contain additional substituents in addition to the 2-carbamoyl group and the AA group.

Preferred $R_3$ groups are hydrogen, methyl, ethyl, butyl, 2-carboxyethyl (—$CH_2CH_2CO_2H$) or its methyl or ethyl esters, 4-carboxyphenyl, 3,5-dicarboxyphenyl, or 4-sulfophenyl. Particularly preferred is where $R_3$ is hydrogen. A water-solubilizing group can be any polar or ionizable substituent that increases the water solubility of the molecule. Typical water solubilizing groups are carboxylic acids, sulfonic acids, sulfonamides, sulfoxamides, phosphoric acids, ethers (especially polyethers), ester, carbamoyl, and hydroxy groups. Preferred are carboxylic or sulfonic acids.

n is 0 or 1, and more preferably n is 1. $R_1$ is an alkyl or alkenyl group of 4 carbon atoms or more or an aryl group of 10 carbon atoms or more. The alkyl or alkenyl group according to $R_1$ may be straight or branched and may optionally contain additional substituents such as water solubilizing groups such as carboxy. The unsaturated bonds in the alkenyl group may be cis or trans. The more preferred $R_1$ groups contain at least 8 carbon atoms or most preferably at least 10 carbon atoms. Suitable examples of $R_1$ are n-hexyl, n-octyl, n-decyl, and n-dodecyl. $R_2$ is an alkyl or aryl group such that the sum total of carbon atoms in $R_1$ and $R_2$ together are at least 5, more preferably at least 10, and most preferably at least 14. If $R_2$ is an alkyl group, then it is preferably methyl or isopropyl. If $R_2$ is an aryl group, it may be substituted or unsubstituted in any position on the ring. Water solubilizing groups such as hydroxy, sulfamoyl, sulfonamido, or carboxy are desirable. Examples of suitable substituents for the aryl ring are o or p-methyl, p-chloro, m-methoxy, p-$NHSO_2CH_3$ or p-CO2H. It is most preferred that $R_2$ be an aryl group.

PUG is any photographic useful group known in the art. Suitable examples of PUG are bleach accelerators, bleach inhibitors, fix accelerators, development accelerators (including electron transfer agents and developing agents), toning agents, Dox scavengers, Dox competitors, or inhibitors of silver development. Particularly preferred are inhibitors of silver development of any type known in the art. Typical examples of inhibitors are oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mereaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. Of these, mercaptotetrazoles, mercaptooxadiazoles, mercaptothiadiazoles, triazoles, and benzotriazoles are preferred. Particularly advantageous are deactivating or self-destructing inhibitors that bear a hydroylzable group such as those described in U.S. Pat. No. 4,782,012; U.S. Pat. No. 5,200,306 and DE 3 209 486 A1, said descriptions incorporated herein by reference. Typically, the hydrolysable group in such self-destructing inhibitors are ester groups which react with some component of the developer solution such as hydroxy ion or hydroxylamine to form the corresponding carboxylic acid substituted inhibitor which is much less effective at silver inhibition.

In one preferred embodiment the coupling moiety is a derivative of 2-carbamoy-1-naphthol, and the PUG released is an inhibitor of silver development. In this embodiment the element is processed with a color developer such as a paraphenylene diamine developer.

Particularly preferred compounds used in the invention are according to Formula (II):

Formula (II)

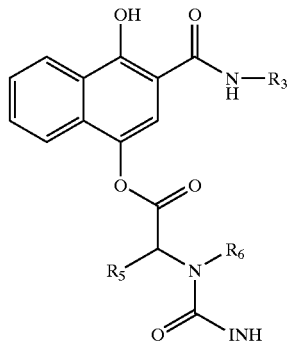

wherein $R_4$ is hydrogen or 2-carboxyethyl (—$CH_2CH_2CO2H$) or its methyl or ethyl esters; $R_5$ is an alkyl group of 4 carbon atoms or more; $R_6$ is an aryl group; and INH is selected from a mercaptotetrazole, a mercaptooxadiazole, a mercaptothiadiazole, a triazole, or a benzotriazole.

The following are some examples of the amino acid compounds (AAC) used in the invention:

AAC-1
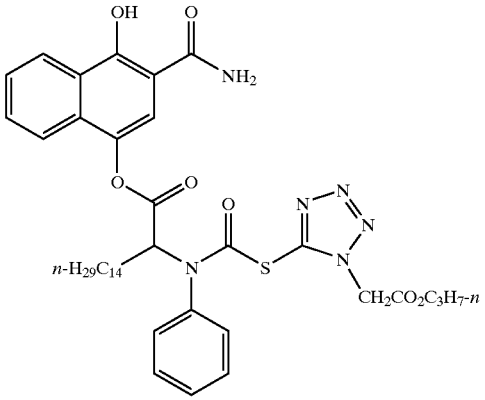
AAC-2
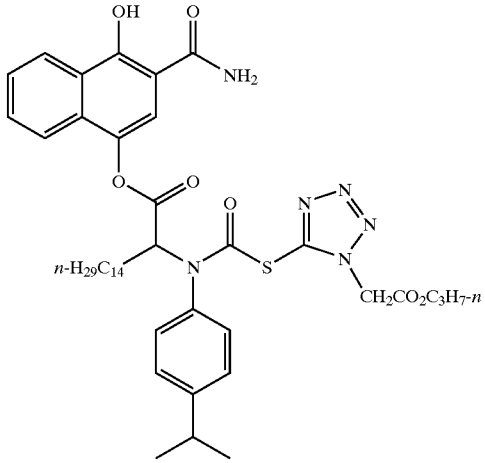
AAC-3
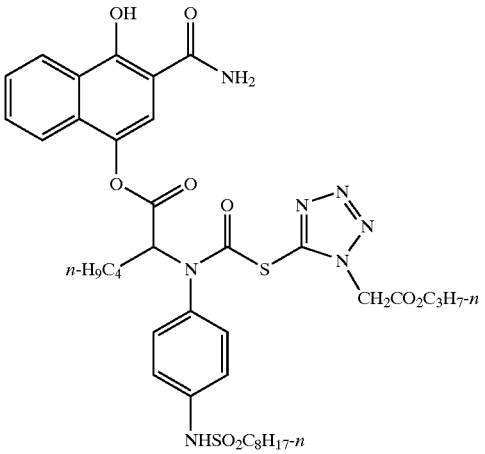
AAC-4
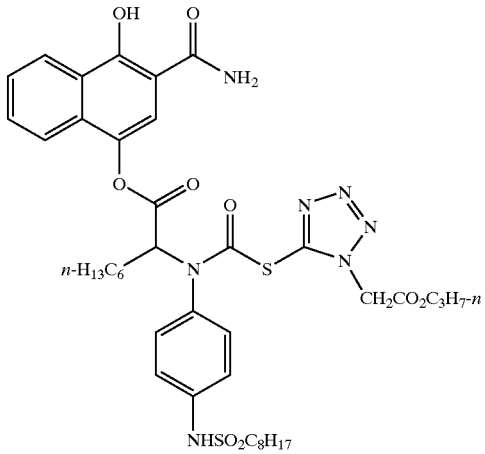
AAC-5
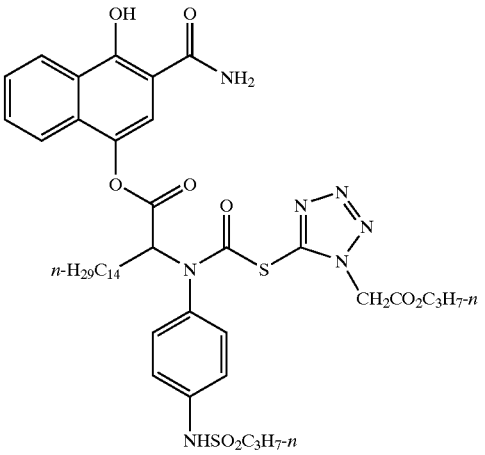
AAC-6
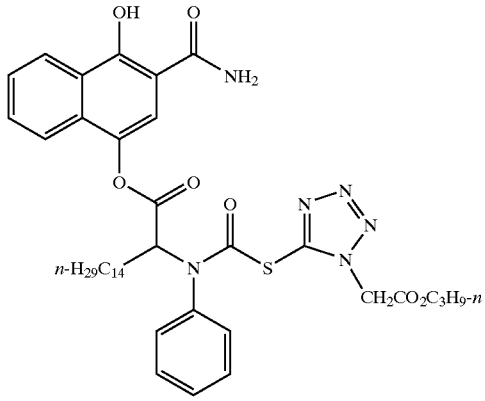

-continued
AAC-7
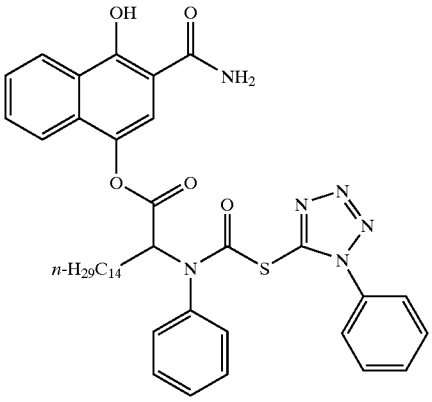
AAC-8
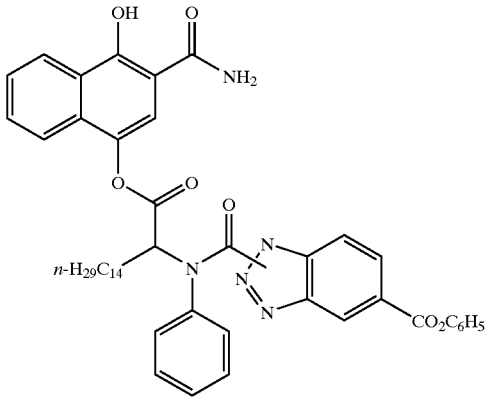
AAC-9
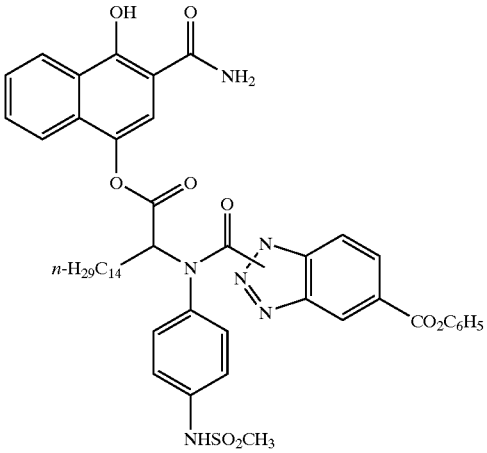
AAC-10
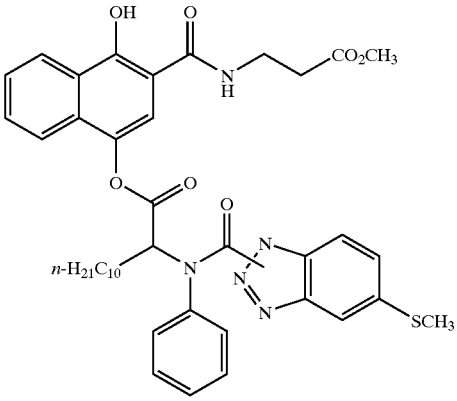
AAC-11
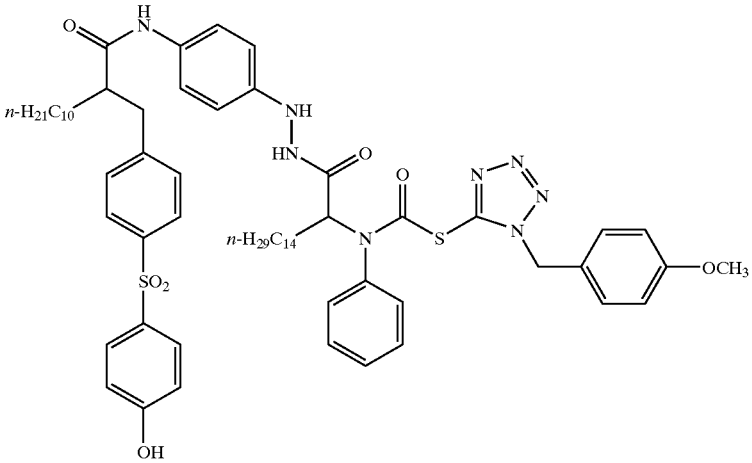
AAC-12
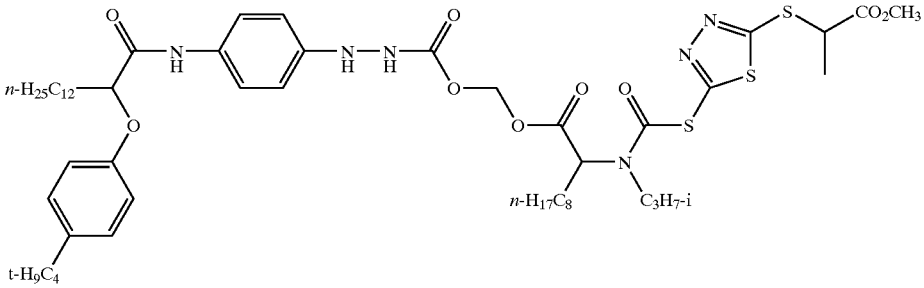

-continued

AAC-13

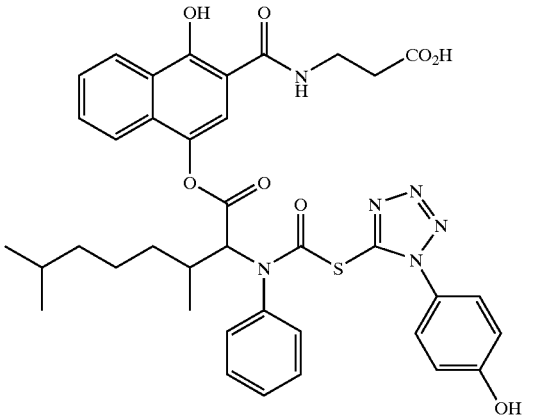

AAC-14

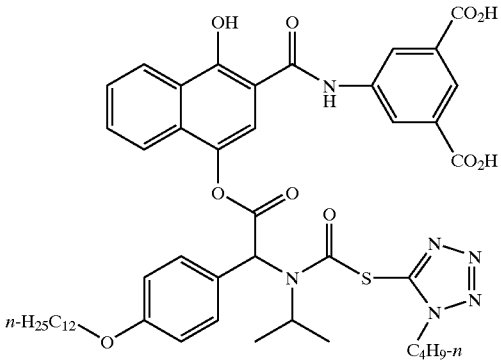

AAC-15

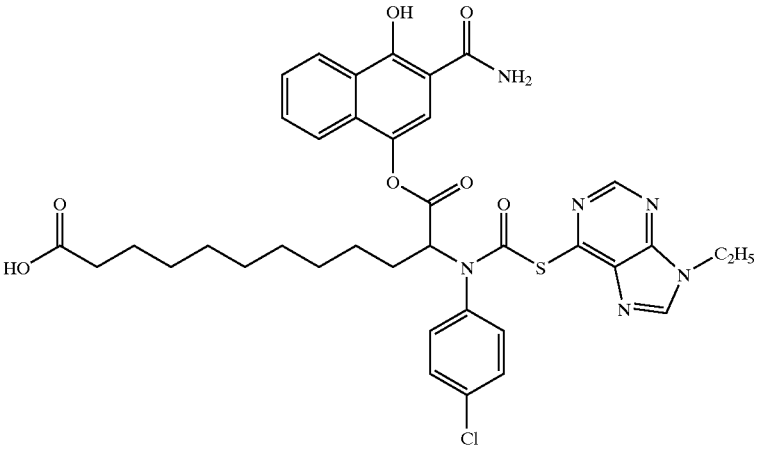

AAC-16

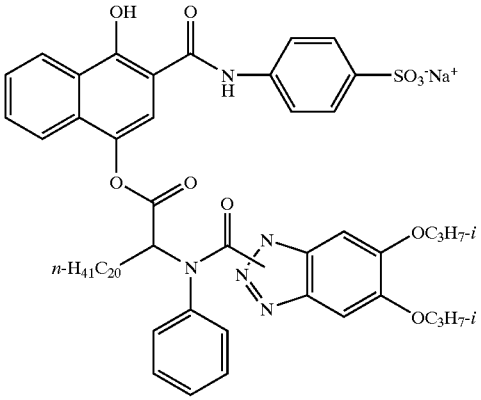

For the amino acid compounds, it should be appreciated that the amount used is a function of other variables such as the location and number of layers in which the compound is located, the solvent used, film dimensions, the nature of the PUG used, and the magnitude of the improvements desired. Typically, the compounds are used in either an imaging or non-imaging layer in the range of 0.00 1to 1 g/m$^2$ or more preferably, 0.0 1to 0.1 g/m$^2$.

The amino acid compounds may be added to or contained in any layer of the photographic element where they are in reactive association with the silver halide emulsion. By "in reactive association with" it is meant that the compounds must be contained in the silver halide emulsion layer or in a layer whereby they can react or interact with, or come in contact with the silver halide emulsion. For example, the compounds can also be added to gelatin-only overcoats or interlayers. In one embodiment the amino acid compound is contained in the silver halide emulsion layer. In another embodiment the amino acid compound is located in a layer adjacent to an imaging layer, particularly in a non-light sensitive layer adjacent to the silver halide emulsion layer.

The amino acid compounds can be added to a mixture containing silver halide before coating or be mixed with the silver halide just prior to or during coating. In either case, additional components like couplers, doctors, surfactants, hardeners, and other materials that are typically present in such solutions may also be present at the same time. The compounds may be added directly if dissolved in an organic water miscible solution such as methanol, acetone or the like or more suitably as a dispersion or suspension. A dispersion incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresyl phosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Preferred classes of solvents are carbonamides, phosphates, phenols, alcohols, and esters. When a solvent is present, it is preferred that the weight ratio of compound to solvent be at least 1 to 0.5, or most preferably at least 1 to 1. Preferred solvents are tricresyl phosphate, N,N-diethyl or N,N-di-n-butyllauramide, di-n-butyl sebacate, p-dodecylphenol, and 2,5-di-t-amylphenol. It is particularly desirable to disperse the compounds in the same solvent that is present with the image coupler that is present in the same layer. The dispersion may require an auxiliary coupler solvent initially to dissolve the component, but this is removed afterwards, usually either by evaporation or by washing with additional water. Some examples of suitable auxiliary coupler solvents are ethyl acetate, cyclohexanone, and 2-(2-butoxyethoxy) ethyl acetate.

The dispersion may also be stabilized by the addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The amino acid compounds may also be dispersed as an admixture with another component of the system such as a coupler or an oxidized developer scavenger so that both are present in the same oil droplet. It is also possible to incorporate the compounds as a solid particle dispersion—that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

The amino acid compounds are also particularly useful when used in film elements that contain low overall silver levels. Thus, films containing 9 g/m$^2$ of total silver or less, or more preferably 5.4 g/m$^2$ or less or even 4.3 g/m$^2$ or less benefit from the use of the amino acid compounds.

In order to control and maintain granularity over a wide exposure range, it is a common practice to divide an individual color record into separate layers, each containing silver halide emulsions of different degree of sensitivity to the same color of light. In particular, while a DIR used in the invention is most useful in the most light-sensitive layer, it can be used in more than one layer that is sensitive to the same color of light. For example, in a color record that is split into three layers of different relative sensitivity; fast (F), mid (M), or slow (S), the compound can be used in each layer only or in any combination, i.e., F+M, F+M+S, F+S, etc. It is not necessary that these layers be adjacent—that is, they may have interlayers or even imaging layers that are sensitive to other colors located between them. It is also possible to use the compounds in more than one color record at a time.

Moreover, when a number of layers of the same spectral sensitivity but of differing degrees of sensitivity to light are used, it is known that overall granularity can be minimized by using a smaller molar amount of dye-forming coupler than silver in the layers of higher sensitivity. Thus, it is preferred that the layers containing the compound used in the invention additionally contain less than a stoichiometric amount of total dye forming coupler(s) relative to the amount of silver contained in the same layer. A suitable molar ratio of dye-forming coupler(s) to silver in the layer containing the compound would be less than 0.5. Most preferred would be a ratio of 0.2 or even 0.1 or less.

It is known that film elements can contain silver halide emulsions in one layer that have maximum sensitivities that are separated or shifted from emulsions in other layers that are sensitive to the same color of light (for example, a layer containing an emulsion with maximum sensitivity at ~530 nm whereas another layer contains a different green light-sensitive emulsion which is most sensitive at ~550 nm) are useful for increasing the amount of interimage and improving color reproduction. The layer containing the emulsions with shifted sensitivities may not contain any image couplers at all, but rather only inhibitor releasing couplers or colored masking couplers. The amino acid compounds are articularly useful in this type of application since they allow for the improved color reproduction while maintaining or increasing speed of the element.

The desired effect of the invention can also be obtained when the amino acid compound is located in a light-insensitive layer, especially one that is preferably adjacent to an imaging layer, particularly the most sensitive layer of a multilayer record. Preferably, the light-insensitive layer is an interlayer located between two light-sensitive imaging layers. The interlayer can be located between two imaging layers sensitive to the same color or different. It is also possible that the interlayer containing the compound is located between an imaging layer and an antihalation layer. The interlayer may also contain additional materials such as oxidized developer scavengers, Carey-Lea (colloidal) silver or colored organic filter dyes. It is preferred for this embodiment that the compound be located in an interlayer between the blue and green sensitive color records or an interlayer between the green and red sensitive color records.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine, iodine or fluorine; nitro; hydroxyl; cyano; carboxyl; or groups which may be further substituted, such as alkyl, including straight- or branched-chain or cyclic alkyl, such as methyl, trifluoromethyl, ethyl, 1-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, teiradecanamido, alpha-(2,4-di-i-pentyl-phenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxopyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylarnino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesul fonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quatemary ammonium, such as triethylammonium; and silyloxy, such as trinmethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight or polymeric backbone containing hydrophobic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

As used herein, the term "color photographic element" means any element containing a light-sensitive silver halide emulsion layer containing an image dye-forming coupler. They can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. A single color element may comprise a combination of couplers in one or more common layers which, upon processing together, form a monocolor, including black or gray, (so-called chromogenic black and white) dye image.

A typical color photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, or subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e., color negative, reversal, or direct positive processing) provided with the element. Suitable emulsions and their preparation, as well as methods of chemical and spectral sensitization, are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in UK. Patents and published application Nos. 1,466,728; 1,531,927; 1,533,039; 2,006,755A; and 2,017,704A, the disclosures of which are incorporated herein by reference.

Image dye-forming couplers may be included in the element such as couplers that form cyan dyes upon reaction with oxidized color-developing agents which are described in such representative patents and publications as: "Farbkuppler-eine Literature Ubersicht," published in Agfa Mitteilungen, Band III, pp. 156–175 (1961), as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; and 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; and German OLS 4,026,903; German OLS 3,624,777; and German OLS 3,823,049. Typically such couplers are phenols, naphthols, or pyrazoloazoles.

Couplers that form magenta dyes upon reaction with oxidized color-developing agent are described in such representative patents and publications as: "Farbkuppler-eine Literature Ubersicht," published in Agfa Mitteilungen, Band III, pp. 126–156 (1961) as well as U.S. Pat. Nos. 2,311,082; 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; and 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; and EPO 0 686 872; WO 90/10253; WO 92/09010; WO 92/10788; WO 92/12464; WO 93/01523; WO 93/02392; WO 93/02393; and WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color-developing agents.

Couplers that form yellow dyes upon reaction with oxidized color-developing agent are described in such representative patents and publications as: "Farbkuppler-eine Literature Ubersicht," published in Agfa Mitteilungen; Band II; pp. 112–126 (1961)); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; and 5,427,898; EPO 0 327 976; EPO 0 296 793; EPO 0 365 282; EPO 0 379 309; EPO 0 415 375; EPO 0437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color-developing agent are described in such representative patents as: UK. 861,138; U.S. Pat. Nos. 3,632,345; 3,928,041; 3,958,993; and 3,961,959. Typically such couplers are cyclic carbonyl containing compounds that form colorless products on reaction with an oxidized color-developing agent.

Couplers that form black dyes upon reaction with oxidized color-developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color-developing agent.

In addition to the foregoing, so-called "universal" or "washout"couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628; 5,151,343; and 5,234,800.

It may be useful to use a combination of couplers, any of which may contain known ballasts or coupling-off groups such as those described in U.S. Pat. Nos. 4,301,235; 4,853,319; and 4,351,897. The coupler may contain solubilizing groups such as described in U.S. Pat. No. 4,482,629. The coupler may also be used in association with "wrong" colored couplers (e.g., to adjust levels of interlayer correction) and, in color negative applications, with masking couplers such as those described in EP 213 490; Japanese Published Application 58-172647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps, e.g., of bleaching or fixing to improve the quality of the image. Bleach accelerator releasing couplers such as those described in EP 193 389 EP 301 477; U.S. Pat. Nos. 4,163,669; 4,865,956; and 4,923,784 may be useful. Also contemplated is use of the compositions in association with nucleating agents, development accelerators or their precursors (UK Patent 2,097,140; UK Patent 2,131,188); electron transfer agents (U.S. Pat. Nos. 4,859,578 and 4,912,025); anti fogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising yellow, cyan, and/or magenta filter dyes, either as oil-in-water dispersions, latex dispersions or as solid particle dispersions. Additionally, they may be used with "smearing" couplers (e.g., as described in U.S. Pat. Nos. 4,366,237; 4,420,556; and 4,543,323 and EP 96,570.) Also, the compositions may be blocked or coated in protected form as described, for example, in Japanese Application 61/258249 or U.S. Pat. No. 5,019,492.

The invention materials may further be used in combination with image-modifying compounds that release PUGS such as "Developer Inhibitor-Releasing" compounds (DIRs). DIRs useful in conjunction with the compositions of the invention are known in the art, and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; and 4,985,336 as well as in patent publications GB 1,560,240; 2,007,662; 2,032,914; and 2,099,167; DE 2,842,063; 2,937,127; 3,636,824; and 3,644,416, as well as the following European Patent Publications: 272,573; 335,319; 336,411; 346,899; 362,870; 365,252; 365,346; 373,382; 376,212; 377,463; 378,236; 384,670; 396,486; 401,612; and 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) that also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles, or benzimidazoles. In a preferred embodiment, the inhibitor moiety or group is selected from the following formulas:

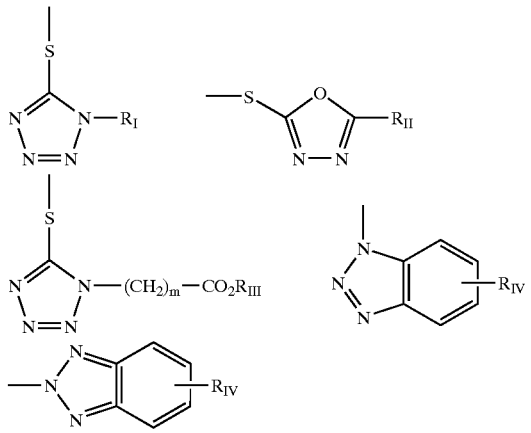

wherein $R_I$ is selected from the group consisting of straight- and branched-alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight- or branched-alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; and 4,861,701, Japanese Applications 57-188035; 58-98728; 58-209736; and 58-209738); groups that function as a coupler or reducing agent after the coupler reaction (U.S. Pat. Nos. 4,438,193 and 4,618,571) and groups that combine the features described above. It is typical that the timing group is of one of the formulas:

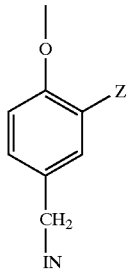

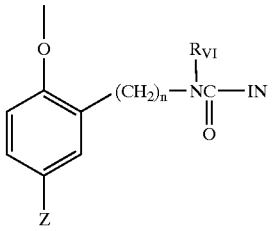

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light-sensitive emulsion layer include, but are not limited to, the following:

D1

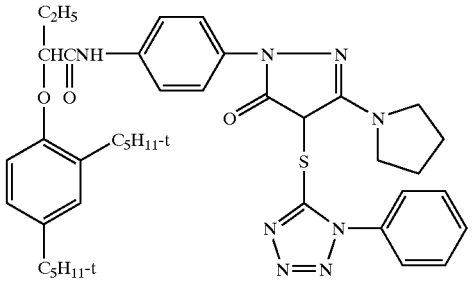

D2

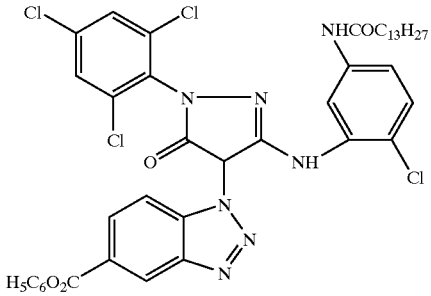

D3

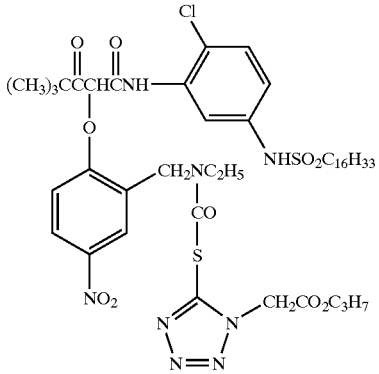

D4

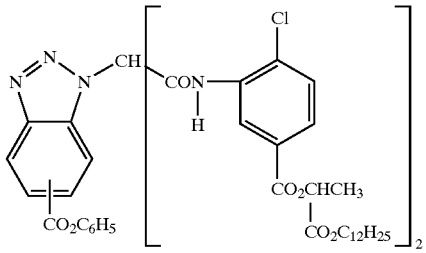

D5

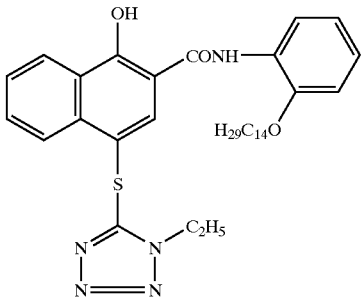

-continued

D6

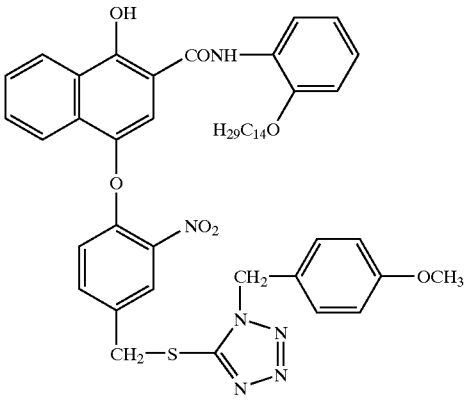

D7

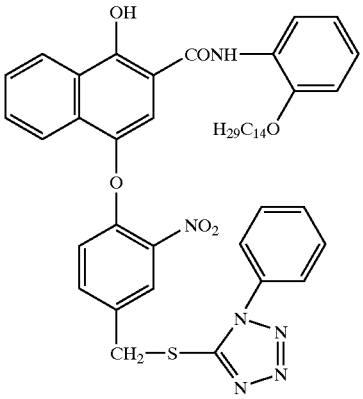

D8

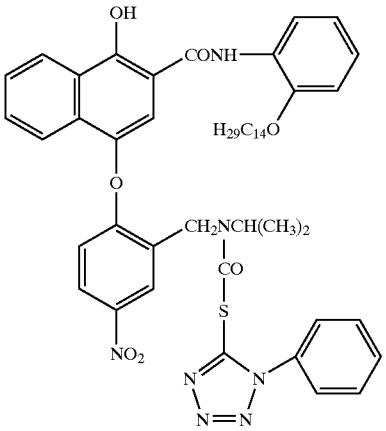

D9

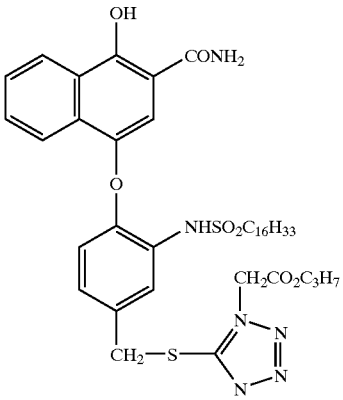

-continued

D10

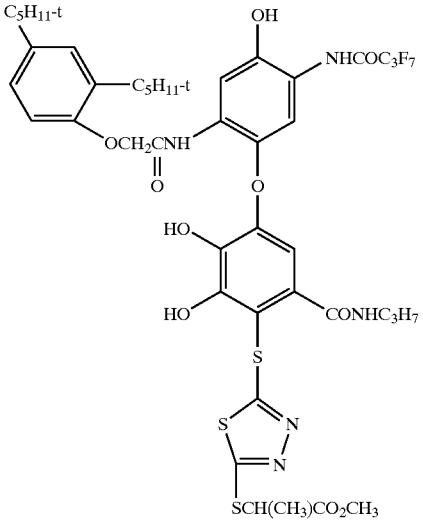

D11

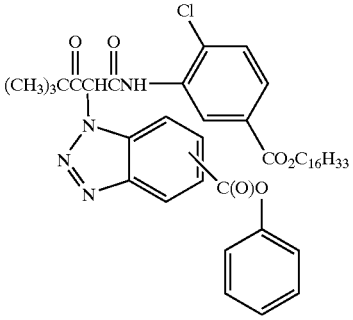

D12

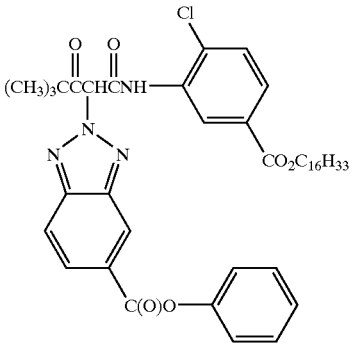

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). The major faces of the tabular grains can lie in either {111} or {100} crystal planes. Specifically contemplated tabular grain emulsions are those in which greater than 50 percent of the total projected area of the emulsion grains are accounted for by tabular grains having a thickness of less than 0.3 micrometer (0.5 micrometer for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECDs seldom exceed about 4 micrometers. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.07 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mol percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above, tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following *Research Disclosure*, Item 22534, January 1983, published by Kenneth Mason Publications, Ltd., Emsworth, Hampshire PO10 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069; and 5,061,616. Tabular grain emulsions consisting predominantly of silver chloride are useful and are described, for example, in U.S. Pat. Nos. 5,310,635; 5,320,938; and 5,356,764.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501; 4,463,087; and 4,173,320; Daubendiek et al U.S. Pat. Nos. 4,414,310 and 4,914,014; Sowinski et al U.S. Pat. No. 4,656,122; Piggin et al U.S. Pat. Nos. 5,061,616 and 5,061,609; Tsaur et al U.S. Pat. Nos. 5,147,771; 5,147,772; 5,147,773; 5,171,659; and 5,252,453; Black et al 5,219,720 and 5,334,495; Delton U.S. Pat. Nos. 5,310,644; 5,372,927; and 5,460,934; Wen U.S. Pat. No. 5,470,698; Fenton et al U.S. Pat. No. 5,476,760; Eshelman et al U.S. Pat. Nos. 5,612,175 and 5,614,359; and Irving et al U.S. Pat. No. 5,667,954.

Ultrathin high bromide {111} tabular grain emulsions are illustrated by Daubendiek et al U.S. Pat. Nos. 4,672,027; 4,693,964; 5,494,789; 5,503,971; and 5,576,168; Antoniades et al U.S. Pat. No. 5,250,403; Olm et al U.S. Pat. No. 5,503,970; Deaton et al U.S. Pat. No. 5,582,965; and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215; Wey et al U.S. Pat. No. 4,414,306; Maskasky U.S. Pat. Nos. 4,400,463; 4,713,323; 5,061,617; 5,178,997; 5,183,732; 5,185,239; 5,399,478; and 5,411,852; and Maskasky et al U.S. Pat. Nos. 5,176,992 and 5,178,998. Ultrathin high chloride { 111 } tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337; 5,292,632; 5,275,930; and 5,399,477; House et al U.S. Pat. No. 5,320,938; Brust et al U.S. Pat. No. 5,314,798; Szajewski et al U.S. Pat. No. 5,356,764; Changet al U.S. Pat. Nos. 5,413,904 and 5,663,041; Oyamada U.S. Pat. No. 5,593,821; Yamashita et al U.S. Pat. Nos. 5,641,620 and 5,652,088; Saitou et al U.S. Pat. No. 5,652,089; and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color-developing agent, in turn, reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41™ process as described in *The British Journal of photography Annual* of 1988, pages 191–198. If a color negative film element is to be subsequently employed to generate a viewable projection print as for a motion picture, a process such as the Kodak ECN-2™ process described in the H-24 Manual available from Eastman Kodak Co. may be employed to provide the color negative image on a transparent support. Color negative development times are typically 3 minutes 15 seconds. The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6™ process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color-developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Of the above, developers based on 4-amino-3-methyl-N-ethyl-N-(2-hydroxyethyl)aniline and 4-amino-3-methyl-N-ethyl-N-(2-methanesulfonamidoethyl)aniline are especially preferred. Moreover, because the amino acid compounds give increased light sensitivity, they are especially useful in processes that have shortened development times. In particular, the film elements of the invention can be processed with development times of less than 3.25 minutes or even less than 3 minutes or in extreme cases, even less than 120 seconds.

Development is usually followed by the conventional steps of bleaching, fixing, or bleach-fixing to remove silver or silver halide, washing, and drying.

The entire contents of the patents and other publications referred to in this specification are incorporated herein by reference.

The following examples illustrate the practice of this invention. They are not intended to be exhaustive of all possible variations of the invention. Parts and percentages are by weight unless otherwise indicated.

EXAMPLES

Synthesis Examples

Step A: Preparation of α-bromoester

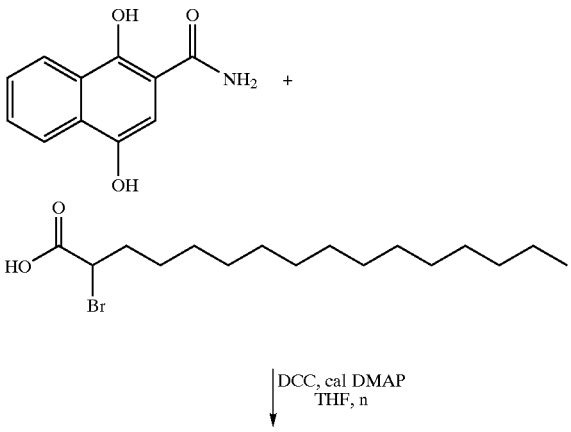

-continued

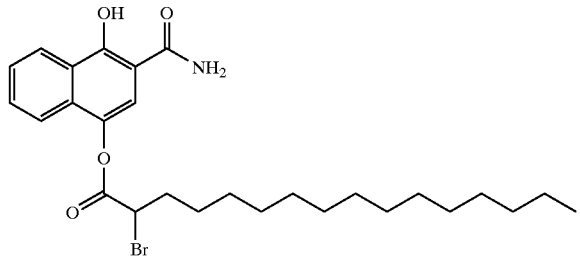

Into a round bottom flask equipped with a mechanical stirrer containing THF (300 mL) was added 1,4-dihydroxy-2-naphthalenecarboxamide (24.3 g, 0.12 moles), 2-bromohexanedecanoic acid (40.14 g, 0.12 moles), and dimethylaminopyridine (250 mg). To this solution was added a solution of dicyclohexylcarbodiimide (26.0 g, 0.126 moles) in THF (150 mL) dropwise. The reaction was stirred at room temperature for 14 hours. At that time, the reaction was filtered through a glass-fritted filter containing celite, followed by washing the precipitate with 1:1 EtOAc/heptane (250 mL). The filtrate was evaporated to dryness. Isolation of the product was accomplished through recrystallization of the crude material using a 4:1 acetonitrile/isopropyl alcohol solution. After isolation and drying of the obtained solid in vacuo at 50° C., a light yellow solid (51.4 g, 0.099 moles) was obtained.

Step B: Preparation of α-Aminoester parent

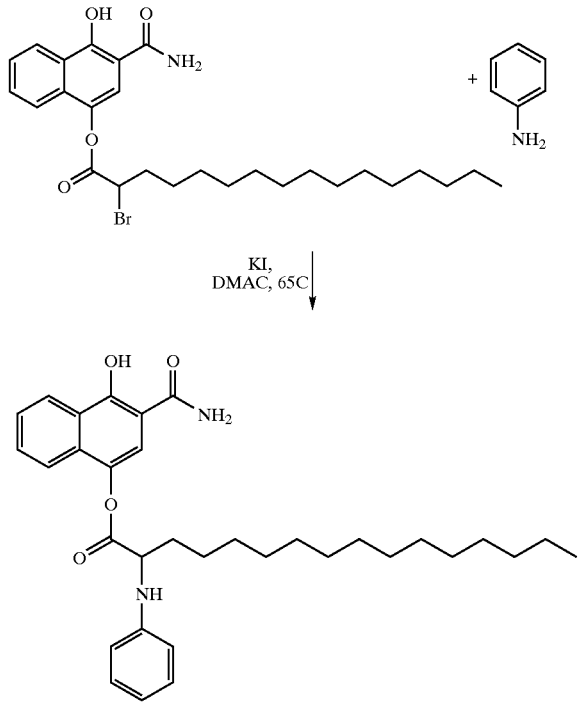

Into a round bottom flask was added the α-bromoester (58.5 g, 0.112 moles), aniline (52.3 g, 0.562 moles), potassium iodide (18.0 g, 0.112 moles), and dimethylacetamide (500 mL). The reaction was warmed to 65° C. and stirred for 24 hours. After cooling, the reaction was poured into 10% HCl (200 mL) then extracted with propyl acetate (500 mL).

The propyl acetate was washed with distilled water (100 mL) and saturated sodium chloride solution (100 mL). After drying the extract over anhydrous magnesium sulfate and filtering, the solvent was removed by evaporation. The product (49.2 g, 0.0924 moles, 82% yield) was isolated as a white solid by recrystallization from 5:1 acetonitrile/isopropyl ether.

Step C: Preparation of Mercaptotetrazole Amino Acid Coupler AAC-1

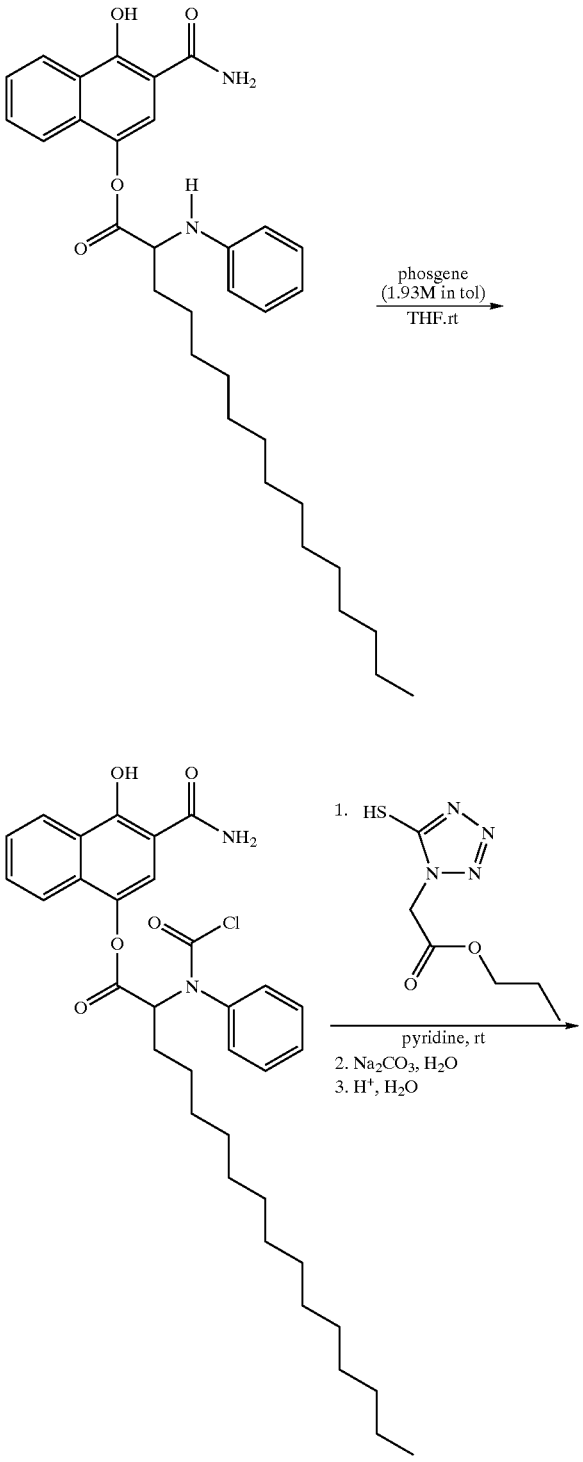

-continued

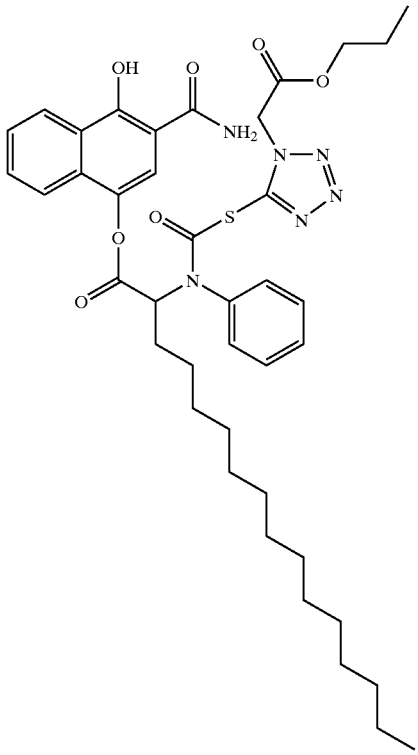

Into a round bottom flask was placed the α-aminoester (6.5 g, 0.0122 moles) and THF (80 mL). To this solution was added a solution of phosgene in toluene ([1.93], 19.0 mL, 0.0367 moles) dropwise. After the addition was complete, the reaction was stirred at room temperature for 3 hours. At that time, the solvent was evaporated maintaining the temperature of the bath ≦35° C. 1:1 THF/heptane was added into the reaction flask and re-evaporated to dryness. The resulting crude carbamoyl chloride was dissolved in pyridine (50 mL) and to this was added the mercaptotetrazole in portions over an hour. The reaction was stirred at room temperature for 14 hours. At that lime, the reaction was poured into an ice/water/con HCl mixture. This mixture was extracted with propyl acetate. The extracts were combined, then washed with saturated $NaHCO_3$, 10% HCl, and saturated sodium chloride solution. After drying over anhydrous magnesium sulfate, filtering, and evaporating, the product (4.9 g, 0.0064 moles, 52% yield) was isolated as light yellow solid by column chromatography on silica gel eluting with a gradient between 10 and 35% propyl acetate/heptane then evaporating the desired fractions.

Step D: Preparation of Benzotriazole Amino Acid Switched Coupler AAC-8

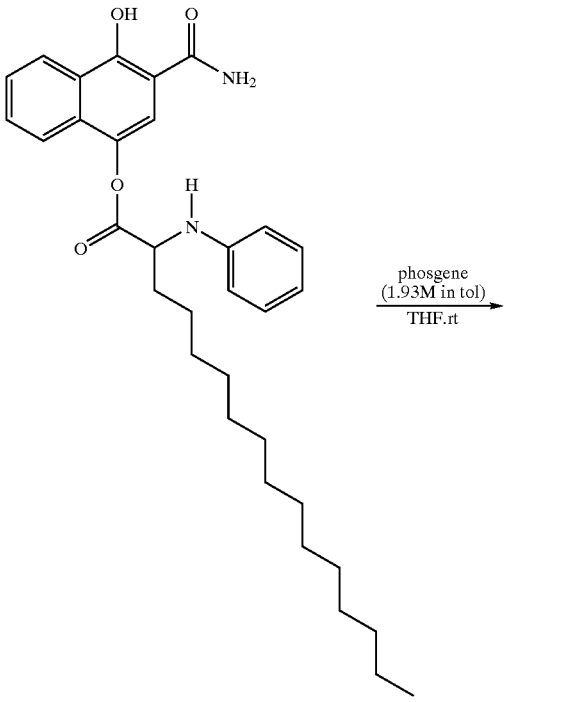

-continued

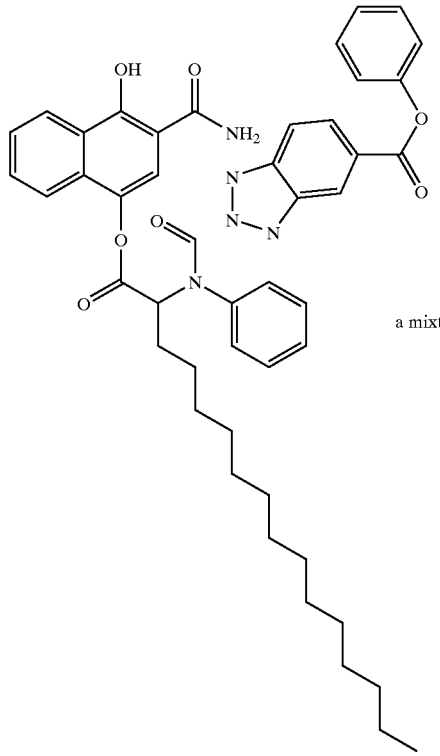

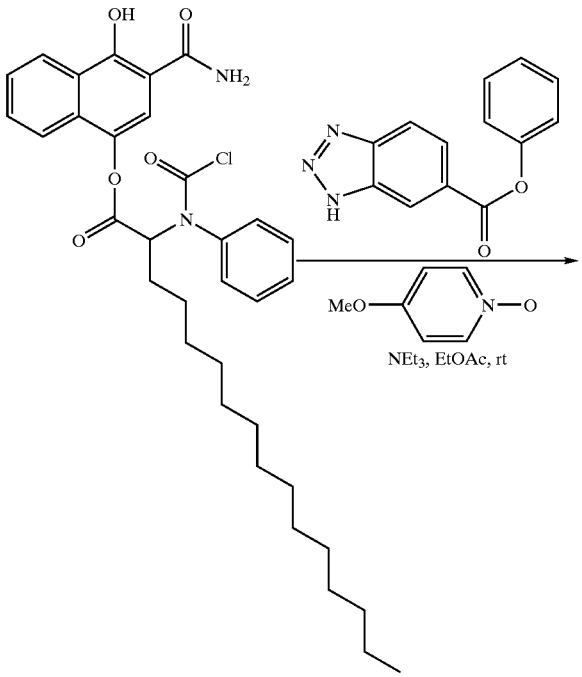

Into a round bottom flask was placed the at-aminoester (2.0 g, 3.75 mmoles) and THF (20 mL). To this solution was added a solution of phosgene in toluene ([1.93], 5.9 mL, 112.5 mmoles) dropwise. After the addition was complete, the reaction was stirred at room temperature for 3 hours. At that time, the solvent was evaporated maintaining the temperature of the bath ≦35° C. 1:1 THF/heptane was added into the reaction flask and re-evaporated to dryness. The resulting crude carbamoyl chloride was dissolved in EtOAc (30 mL) and to this was added the substituted benzotriazole (0.88 g, 36.25 mmol), 4-methoxypyridine N-oxide (100 mg), and triethylamine (3.8 g, 37.5 mmol). The reaction was stirred at room temperature for 14 hours. An additional amount of ethyl acetate was added, then was washed with 5% HCl, and saturated sodium chloride solution. After drying over anhydrous magnesium sulfate, filtering, and evaporating, the product (1.9 g, 2.38 mmoles, 63% yield, mixture of isomers) was isolated as an off-white solid by column chromatography on silica gel eluting with a gradient between 5 and 25% ethyl acetate/heptane then evaporating the desired fractions.

Photographic Examples

Multilayer films demonstrating the principles of this invention were produced by coating the following layers on a cellulose triacetate film support (coverage are in grams per meter squared, emulsion sizes as determined by the disc centrifuge method and are reported in diameter x thickness in micrometers). Surfactants, coating aids, emulsion addenda (including 4-hydroxy-6-methyl-1,3,3a,7-tetraazaindene), sequestrants, thickeners, lubricants, matte, and tinting dyes were added to the appropriate layers as is common in the art.

Sample ML-1:

Layer 1 (Antihalation layer): gelatin at 1.08, colloidal gray silver at 0.150; ILS-1 at 0.097; DYE-1 at 0.029;

DYE-2 at 0.065; DYE-3 at 0.021; CH-1 at 0.025; and UV-1 at 0.075.

Layer 2 (Slow cyan layer): a blend of two red-sensitized (all with a mixture of RSD-1 and RSD-2) tabular silver iodobromide emulsions: (i) 0.81×0.11 μm, 4.5 mol % I at 0.400, (ii) 0.62×0.111 μm, 4.1 mol % iodide at 0.175; cyan dye-forming couplers C-1 at 0.248 and C-2 at 0.236; bleach accelerator releasing coupler B-1 at 0.086; image modifier DIR-1 at 0.032; OxDS-1 at 0.010; and gelatin at 1.08.

Layer 3 (Mid cyan layer): a red-sensitized (with a mixture of RSD-1 and RSD-2) iodobromide tabular emulsion (1.44×0.13 μm, 3.7 mol % 1) at 0.572; C-1 at 0.265; C-2 at 0.103; B-1 at 0.011; DIR-2 at 0.043; masking coupler MC-1 at 0.022; and gelatin at 1.08.

Layer 4 (Fast cyan layer): a red-sensitized (with a mixture of RSD-1, RSD-2 and RSD-3) iodobromide tabular emulsion (2.41×0.13 μm, 3.7 mol % 1) at 1.286; C-1 at 0.163; DIR-2 at 0.0.054; B-1 at 0.008; and gelatin at 1.08.

Layer 5 (Ultra-fast cyan layer): a red-sensitized (with a mixture of RSD-1, RSD-2 and RSD-3) iodobromide tabular emulsion (3.87×0.13 μm, 3.7 mol % 1) at 1.180; C-2 at 0.175; DIR-3 at 0.060; DIR-4 at 0.001; and gelatin at 1.08.

Layer 6 (Interlayer): ILS-1 at 0.075 and gelatin at 1.08.

Layer 7 (Slow magenta layer): a blend of two green-sensitized (both with a mixture of GSD-1 and GSD-2) silver iodobromide tabular emulsions: (i) 1.17×0.12 μm, 4.5 mol % iodide at 0.156 and (ii) 0.62×0.0.111 μm, 2.6 mol % iodide at 0.573; magenta dye-forming coupler M-1 at 0.300; MC-2 at 0.090; CD-1 at 0.032; ILS-1 at 0.011; and gelatin at 1.400.

Layer 8 (Mid magenta layer): a blend of two green-sensitized (both with a mixture of GSD-1 and GSD-2) silver iodobromide tabular emulsions: (i) 2.46×0.13 μm, 3.7 mol % iodide at 0.534 and (ii) 1.45×0.0.13 μm, 3.7 mol % iodide at 0.370; M-1 at 0.089; MC-2 at 0.086; CD-1 at 0.025; ILS-1 at 0.012; and gelatin at 1.438.

Layer 9 (Fast magenta layer): a green-sensitized (with a mixture of GSD-1 and GSD-2) silver iodobromide tabular emulsion (2.90×0.13 μm, 3.7 mol % iodide) at 1.240; MC-2 at 0.021; DIR-6 at 0.003; M-1 at 0.104; ILS-1 at 0.014; and gelatin at 1.496.

Layer 10 (Interlayer): ILS-1 at 0.182 and gelatin at 0.700.

Layer 11 (Slow yellow layer): a blend of three blue-sensitized (all with BSD-1 and BSD-2) tabular silver iodobromide emulsions (i) 2.41×0.140 μm, 2.0 mol % 1 at 0.402, (ii) 1.02×0.137 μm, 2.0 mol % 1 at 0.136, (iii) 0.62×0.111 μm, 2.6 mol % 1 at 0.505; yellow dye forming coupler Y-1 at 0.850; DIR-1 at 0.022; DIR-7 at 0.038; B-1 at 0.009; and gelatin at 1.90.

Layer 12 (Fast yellow layer): a blue-sensitized (with BSD-1 and BSD-2) tabular silver iodobromide emulsion, 3.72×0.131 μm, 3.7 mol % 1 at 0.070 and a blue-sensitized (with BSD-1) 3-D silver iodobromide emulsion, 1.21 μm diameter), 9.7 mol % 1 at 1.055; Y-1 at 0.312; DIR-7 at 0.065; B-1 at 0.011; stabilizer S-1 at 0.008; and gelatin at 1.280.

Layer 13 (UV Filter Layer): silver bromide LippmanN emulsion at 0.215; UV-1 and UV-2 both at 0.108; and gelatin at 0.700.

Layer 14 (Protective overcoat): gelatin at 0.888 and bis(vinylsulfonyl)methane hardener at 1.75% of total gelatin weight.

All comparative and inventive image modifiers were dispersed in twice their own weight in tricresylphosphate. The image modifiers that release a self-destruct type of mercaptotetrazole were coated at 0.083 mmole/$m^2$ in Layer 9. The image modifiers that release phenylmercaptotetrazole or a benzotriazole were coated at 0.041 mmol/$m^2$ in Layer 9.

Formulas for materials used in the above formats are as follows:

ILS-1:

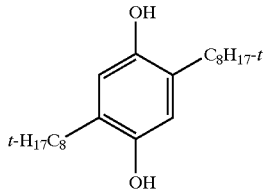

DYE-1:

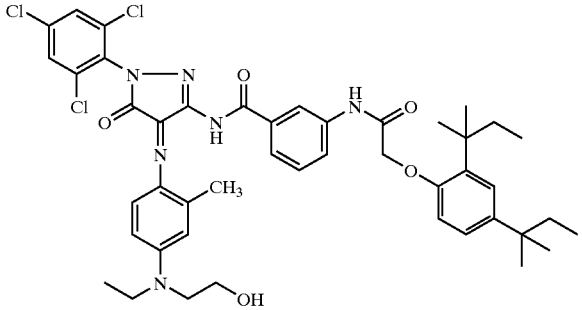

DYE-2:

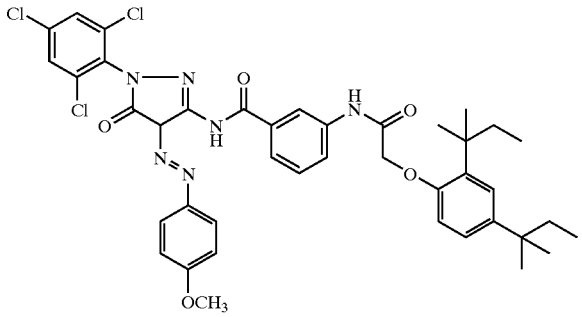

DYE-3:

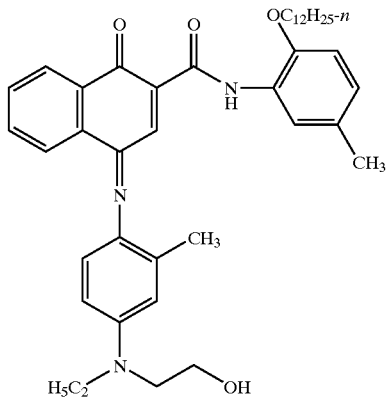

-continued
UV-1:
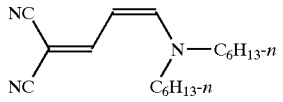
C-1:
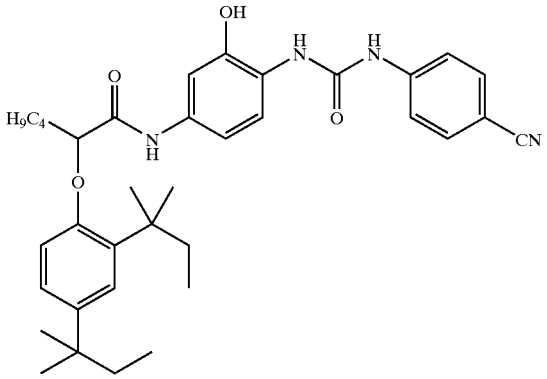
C-2:
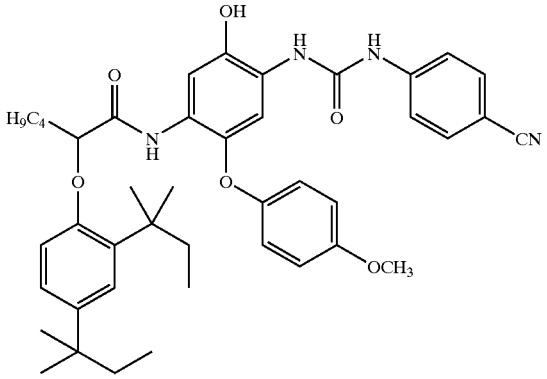
B-1:
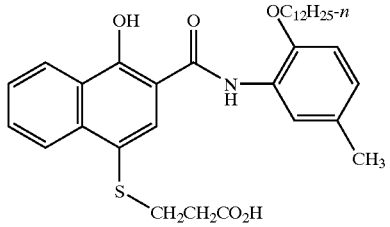
-continued
DIR-1:
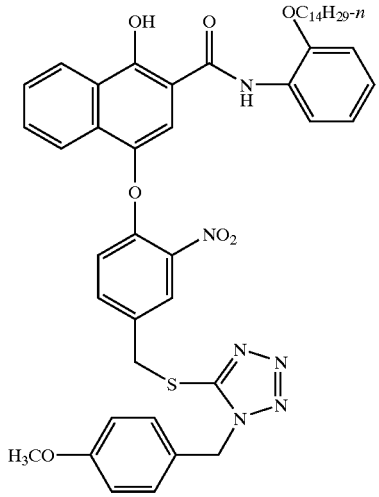
OxDS-1:
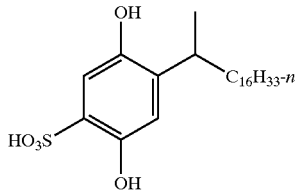
DIR-2:
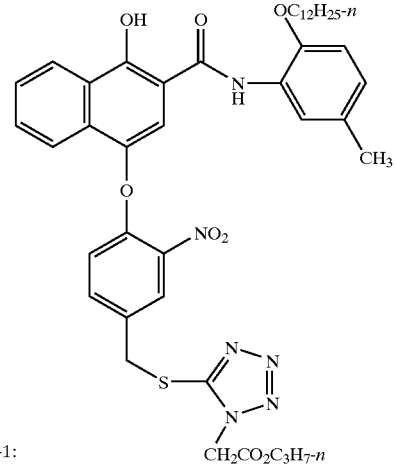
MC-1:
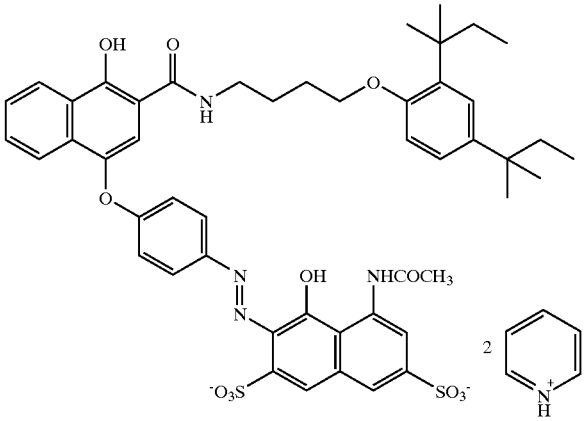

-continued
DIR-3:
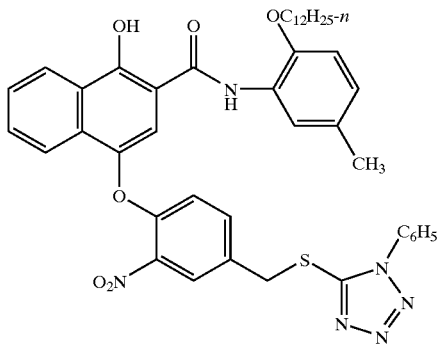
DIR-4:
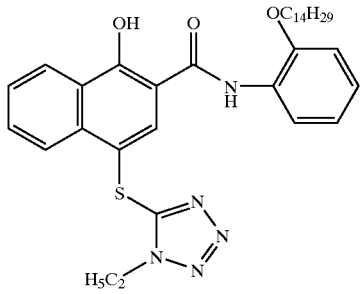
M-1:
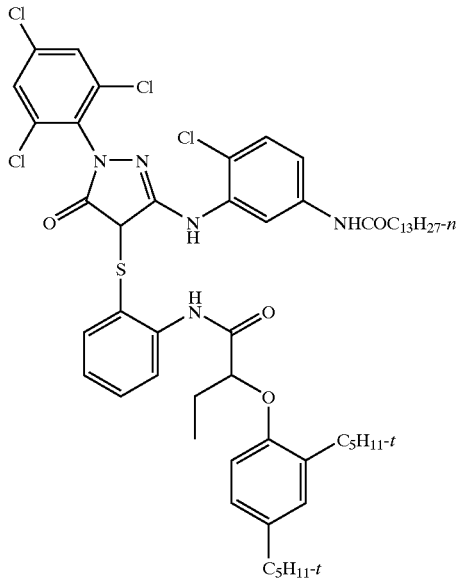
-continued
MC-2:
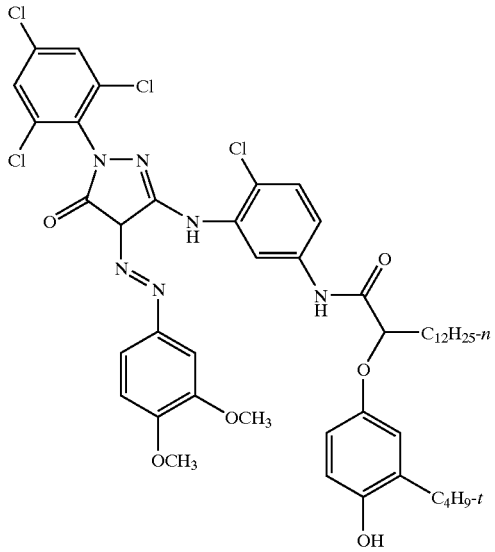
DIR-6:
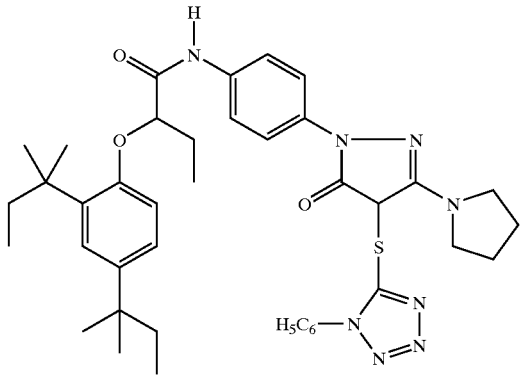
Y-1:
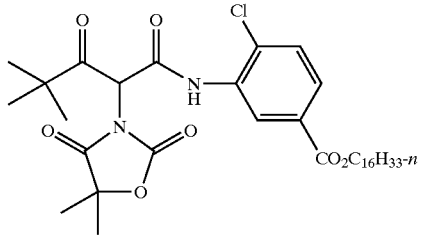
DIR-7:
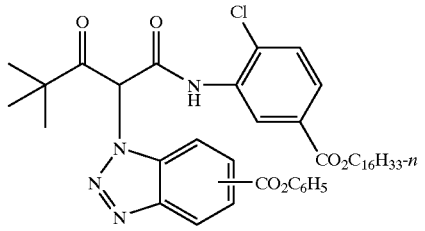

-continued
S-1:
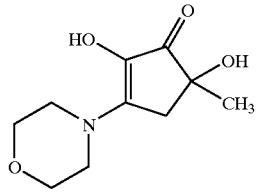
UV-2:
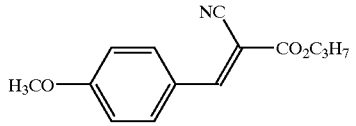
BSD-1:
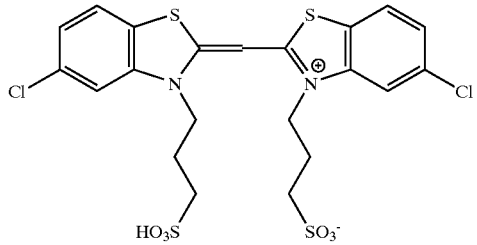
BSD-2:
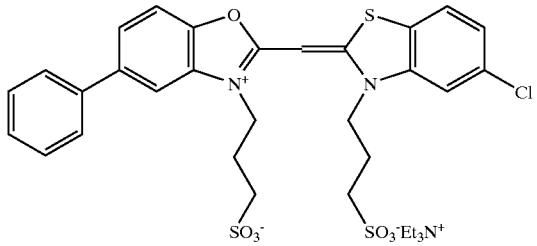
GSD-1:
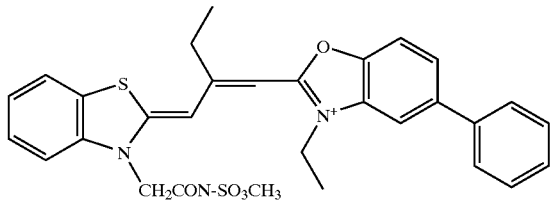
GSD-2:
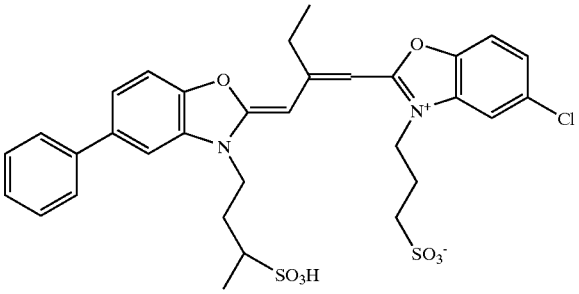
-continued
RSD-1:
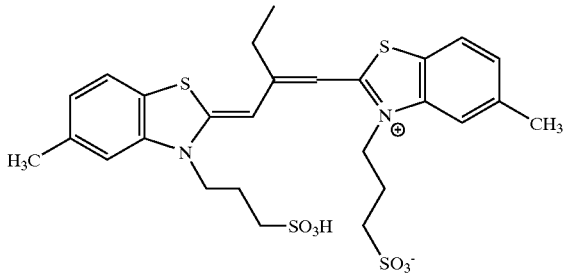
RSD-2:
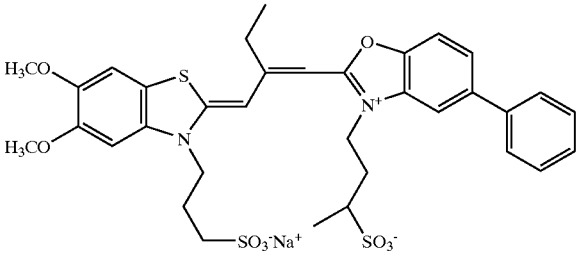
RSD-3:
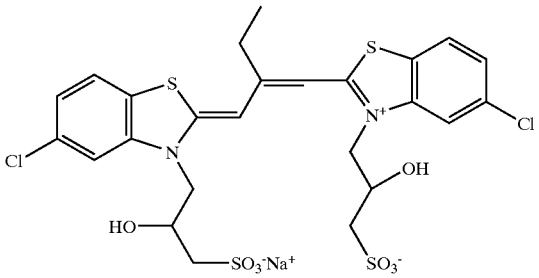
The structures of the comparative DIRs are as follows:
CD-1
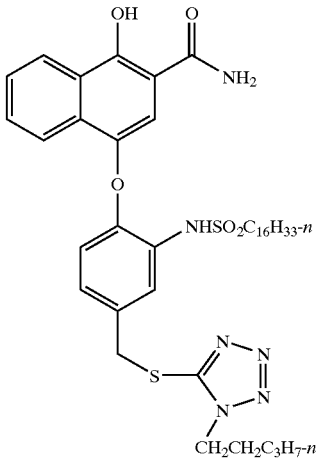

-continued

CD-2

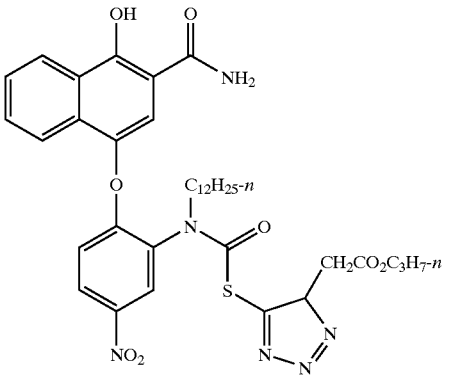

CD-3

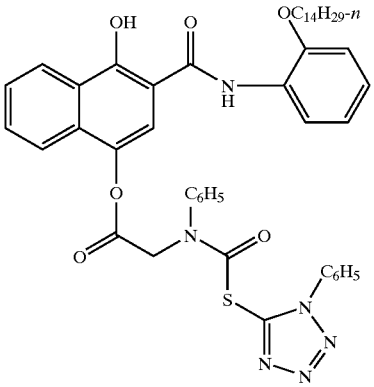

CD-4

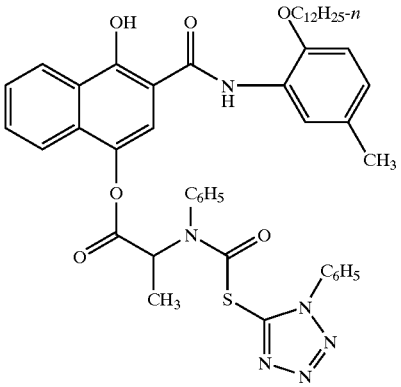

CD-5

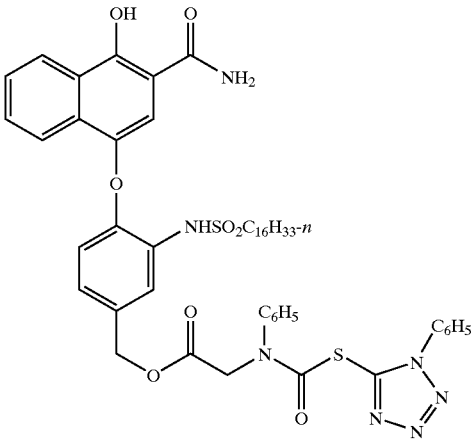

-continued

CD-6

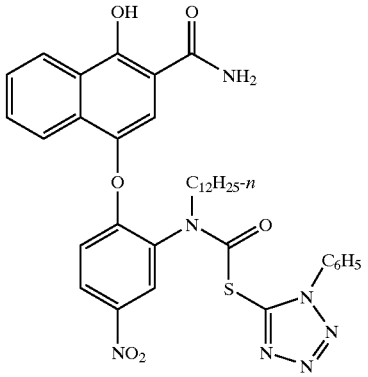

CD-7

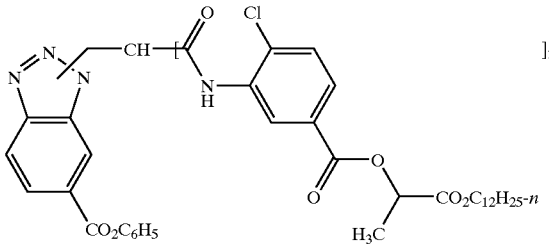

CD-8

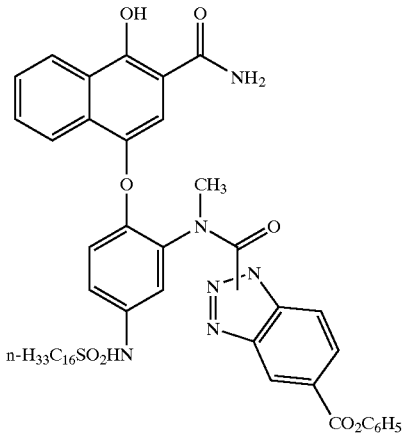

To determine speed these multilayer coatings were given a stepped neutral exposure and processed in the KODAK FLEXICOLOR™ (C-41) process as described in *British Journal of Photography Annual*, 1988, pp 196–198. Relative speed or light sensitivity was determined by comparing the ratio of the exposure points+0.15 green density units above green Dmin of the experimental coating with the DIR to the check position without any DIR. A ratio greater than 1.0 implies increased speed; a ratio less than one implies a loss in speed. To determine green-onto-red (GR) interimage, these multilayer coatings were given a stepped exposure in the green record while the red and blue color layers were simultaneously given a uniform, nonimagewise flash exposure so that the red density ($R_{minG}$) where there was no green record development (minimum green exposure point) was close to 1.0. Then, a green exposure point was determined that was 0.6 logE units less than the point that was 0.15 red density units above green Dmin. The red density ($R_G$) was read at this red exposure point. GR interimage is the difference in red density $R_G$–$R_{minG}$ and represents the decrease in red layer development as a function of green. The green-onto-blue (GB) interimage was determined in a similar fashion except that the blue density where there was no green record development was close to 1.6. In both cases, a negative number reflects a greater loss in density and hence, an increase in green-onto-red or blue interimage.

TABLE 1

| Self-destruct Mercaptotetrazole Releasing DIRs | | | | | |
|---|---|---|---|---|---|
| Sample | Comp/ Inv | Addenda | Relative Speed | GR Interimage | GB Interimage |
| ML-1 | Comp | None | 1.0 | +0.009 | −0.044 |
| ML-2 | Comp | CD-1 | 0.94 | −0.036 | −0.086 |
| ML-3 | Comp | CD-2 | 0.98 | −0.015 | −0.060 |
| ML-4 | Inv | AAC-1 | 0.98 | −0.020 | −0.069 |
| ML-5 | Inv | AAC-2 | 0.98 | −0.023 | −0.063 |
| ML-6 | Inv | AAC-3 | 0.99 | −0.021 | −0.061 |
| ML-7 | Inv | AAC-4 | 0.98 | −0.025 | −0.062 |
| ML-8 | Inv | AAC-5 | 0.98 | −0.019 | −0.077 |
| ML-9 | Inv | AAC-6 | 0.97 | −0.019 | −0.066 |

Table 1 compares the results from DIRs that all release a self-destruct mercaptotetrazole inhibibitor. Comparative DIR CD-1 represents a universal DIR with a ballasted quinone-methide switch. This ballasted quinone-methide switch releases the inhibitor practically instantaneously on the photographic timescale resulting in a speed loss. Comparative DIR CD-2 represents a universal DIR with a ballasted carbamate switch. This ballasted carbamate releases the inhibitor slowly on the photographic timeframe, which minimizes the speed loss, but also is insufficient in terms of interimage because the switch-INH fragment is unable to diffuse. Only the ballasted amino acid switches of the inventive compounds (AAC-1 to -6) minimize the speed loss while unexpectedly providing increased interimage.

TABLE 2

| Phenylmercaptotetrazole Releasing DIRs | | | | | |
|---|---|---|---|---|---|
| Sample | Comp/ Inv | Addenda | Relative Speed | GR Interimage | GB Interimage |
| ML-1 | Comp | None | 1.0 | +0.009 | −0.044 |
| ML-10 | Comp | CD-3 | 0.98 | +0.010 | −0.060 |
| ML-11 | Comp | CD-4 | 0.98 | +0.006 | −0.076 |
| ML-12 | Comp | CD-5 | 0.95 | −0.070 | −0.090 |
| ML-13 | Comp | CD-6 | 0.99 | −0.012 | −0.047 |
| ML-14 | Inv | AAC-7 | 0.98 | −0.021 | −0.058 |

Table 2 compares the results from DIRs that all release phenylmercaptotetrazole as an inhibibitor. Comparative DIRs CD-3 and CD-4 represent cyan DIRs with non-ballasted amino acid switches. While these DIRs minimize speed loss, they are unsuitable for providing green-onto-red interimage because of the cyan parent coupler. Comparative DIR CD-5 represents a universal DIR with two switches: an initial ballasted quinone-methide switch which cannot diffuse but almost immediately releases a second non-ballasted amino acid switch which can diffuse. This allows for excellent interimage. However, such compounds are extremely difficult to prepare and do cause some speed loss. Comparative DIR CD-6 represents a universal DIR with a ballasted carbamate switch which minimizes the speed loss but does not provide sufficient interimage. Only the inventive DIR AAC-7 allows for increased interimage and minimal speed loss while providing a simple and manufacturable synthesis.

TABLE 3

| Benzotriazole Releasing DIRs | | | | | |
|---|---|---|---|---|---|
| Sample | Comp/ Inv | Addenda | Relative Speed | GR Interimage | GB Interimage |
| ML-1 | Comp | None | 1.0 | +0.009 | −0.044 |
| ML-15 | Comp | CD-7 | 0.97 | −0.040 | −0.017 |
| ML-16 | Comp | CD-8 | 0.99 | −0.024 | −0.024 |
| ML-17 | Inv | AAC-8 | 0.99 | −0.042 | −0.043 |
| ML-18 | Inv | AAC-9 | 0.99 | −0.048 | −0.048 |

Table 3 compares the results from DIRs that all release a self-destruct benzotriazole as an inhibibitor. Comparative DIR CD-7 represents a yellow DIR which is unsuitable for providing green-onto-blue interimage because of the yellow parent coupler. Comparative DIR CD-8 represents a universal DIR with a ballasted carbamate switch which minimizes the speed loss but does not provide sufficient interimage. Only the inventive DIRs AAC-8 and -9 provides increased interimage and minimal speed loss.

The invention has been described in detail with particular reference to preferred embodiments thereof, but it will be understood that variations and modifications can be effected within the scope and spirit of the invention.

What is claimed is:

1. A color silver halide photographic element comprising a light-sensitive silver halide emulsion layer, said silver halide emulsion being in reactive association with an amino acid compound according to Formula (I):

Formula (I)

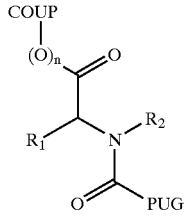

wherein:

COUP is a moiety that reacts with oxidized developer to release the amino acid timing group but does not substantially contribute any density in the visible region to the element after processing is complete;

n is 0 or 1;

$R_1$ is an alkyl or alkenyl group of 4 carbon atoms or more or an aryl group with 10 carbon atoms or more;

$R_2$ is an alkyl or aryl group so the sum total of carbon atoms in $R_1$ and $R_2$ together are at least 5; and PUG is a photographically useful group.

2. The color photographic element of claim 1 wherein the PUG is an inhibitor of silver development.

3. The color photographic element of claim 2 wherein the inhibitor is a mercaptotetrazole, a mercaptooxadiazole, a mercaptothiadiazole, a triazole, or a benzotriazole.

4. The color photographic element of claim 3 wherein the inhibitor is a self-destructing inhibitor that bears a hydrolysable group.

5. The color photographic element of claim 1 wherein COUP is a 2-carbamoyl-1-naphthol moiety.

6. The color photographic element of claim 2 wherein COUP is a 2-carbamoyl-1-naphthol moiety.

7. The color photographic element of claim 6 wherein the inhibitor is a mercaptotetrazole, a mercaptooxadiazole, a mercaptothiadiazole, a triazole, or a benzotriazole.

8. A color silver halide photographic element of claim 7 wherein the inhibitor is a self-destructing inhibitor that bears a hydrolysable group.

9. A color photographic element of claim 1 wherein $R_1$ is an alkyl group of 4 carbon atoms or more and $R_2$ is an aryl group.

10. A color photographic element of claim 9 wherein COUP is a 2-carbamoyl-1-naphthol moiety.

11. The color photographic element of claim 10 wherein the amino acid compound is according to Formula (II):

Formula (II)

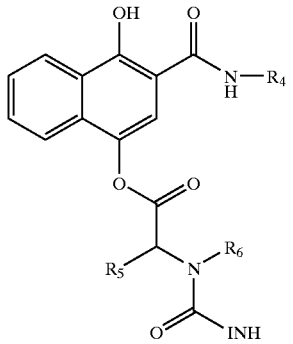

wherein $R_4$ is hydrogen or 2-carboxyethyl (—$CH_2CH_2CO_2H$) or its methyl or ethyl esters;

$R_5$ is an alkyl group of 4 carbon atoms or more;

$R_6$ is an aryl group; and

INH is selected from a mercaptotetrazole, a mercaptooxadiazole, a mercaptothiadiazole, a triazole, or a benzotriazole.

12. The color photographic element of claim 11 wherein $R_4$ is hydrogen.

13. The color photographic element of claim 1 wherein the element comprises a color record that is composed of two or more silver halide emulsion layers of differing light sensitivity and the amino acid compound is located in the most light sensitive layer.

14. The color photographic element of claim 10 wherein the element comprises a color record that is composed of two or more silver halide emulsion layers of differing light sensitivity and the amino acid compound is located in the most light sensitive layer.

15. The color photographic element of claim 1 wherein the total amount of silver contained in the element is 5.4 $g/m^2$ or less.

16. The color photographic element of claim 10 wherein the total amount of silver contained in the element is 5.4 $g/m^2$ or less.

17. The color photographic element of claim 1 wherein the element comprises a light insensitive layer adjacent to the silver halide emulsion layer and the amino acid compound is located in the light insensitive layer.

18. The color photographic element of claim 10 wherein the element comprises a light insensitive layer adjacent to the silver halide emulsion layer and the amino acid compound is located in the light insensitive layer.

19. The color photographic element of claim 10 wherein the amino acid compound is

AAC-1

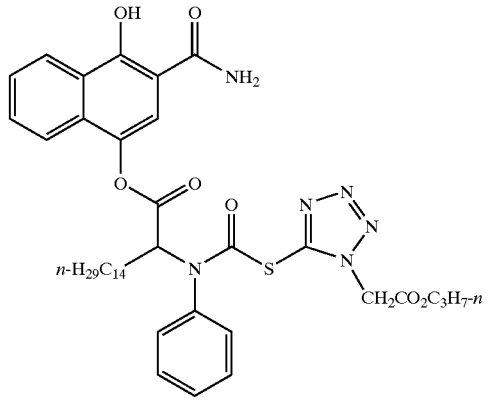

AAC-5

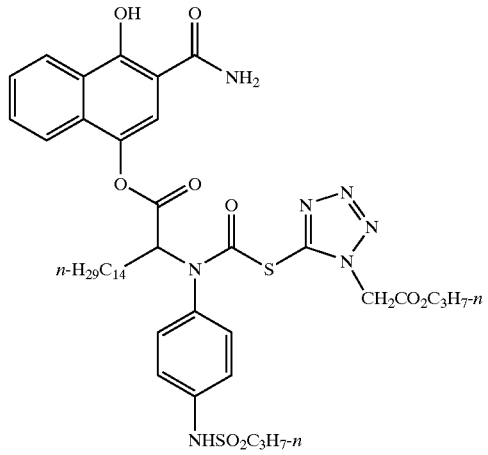

AAC-6

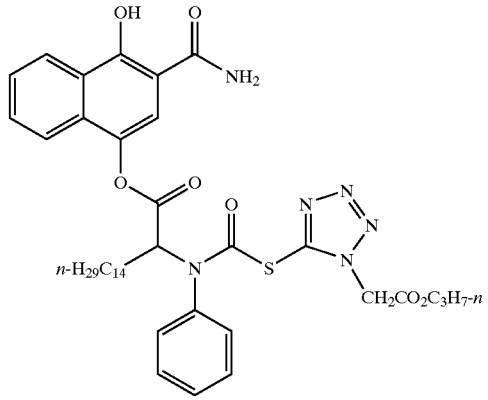

-continued
AAC-7
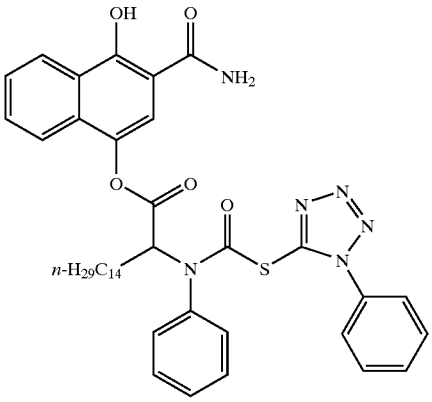
AAC-8
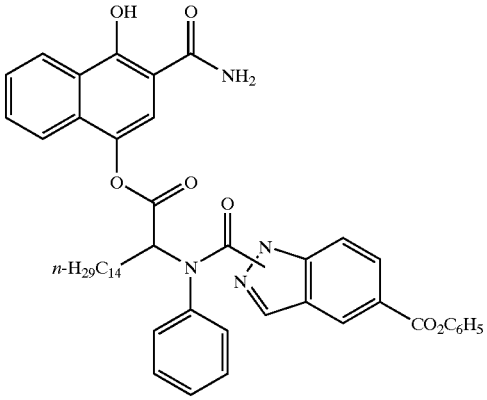
or
-continued
AAC-9
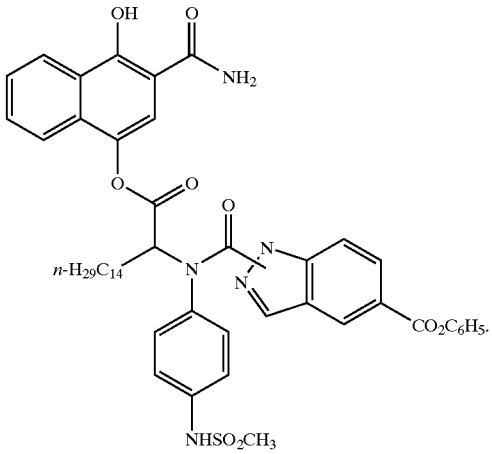
20. A process for forming a photographic image, comprising contacting the element as described in claim 1 with a p-phenylenediamine color developer.
21. The process of claim 20 wherein the color developer comprises 2-[(4-amino-3-methylphenyl)ethylamino]ethanol or 4-amino-3-methyl-N-ethyl-N-(2-methanesulfonamidoethyl)aniline.
* * * * *